US009528211B2

(12) United States Patent
Lew

(10) Patent No.: US 9,528,211 B2
(45) Date of Patent: Dec. 27, 2016

(54) CLEANING APPARATUS

(71) Applicant: Tatung Company, Taipei (TW)

(72) Inventor: Shiow-Jeng Lew, Taipei (TW)

(73) Assignee: Tatung Company, Taipei (TW)

( * ) Notice: Subject to any disclaimer, the term of this patent is extended or adjusted under 35 U.S.C. 154(b) by 206 days.

(21) Appl. No.: 14/520,362

(22) Filed: Oct. 22, 2014

(65) Prior Publication Data

US 2015/0292133 A1 Oct. 15, 2015

(30) Foreign Application Priority Data

Apr. 9, 2014 (TW) ..... 103113039 A

(51) Int. Cl.

| | |
|---|---|
| ***D06F 13/04*** | (2006.01) |
| ***D06F 15/00*** | (2006.01) |
| ***D06F 17/02*** | (2006.01) |
| ***D06F 19/00*** | (2006.01) |
| ***D06F 18/00*** | (2006.01) |
| ***D06F 39/00*** | (2006.01) |
| *D06F 17/04* | (2006.01) |

(52) U.S. Cl.

CPC ..... *D06F 13/04* (2013.01); *D06F 15/00* (2013.01); *D06F 17/02* (2013.01); *D06F 18/00* (2013.01); *D06F 19/00* (2013.01); *D06F 39/00* (2013.01); *D06F 17/04* (2013.01)

(58) Field of Classification Search

CPC ..... D06F 13/04; D06F 15/00; A47L 15/04; A47L 15/28; A47L 15/34; A47L 15/36; A47L 15/37; A47L 15/39

See application file for complete search history.

(56) References Cited

U.S. PATENT DOCUMENTS 1,373,792 A * 4/1921 Bogre ..... D06F 15/00 68/73
1,524,979 A * 2/1925 Koger ..... D06F 15/00 68/112

(Continued)

FOREIGN PATENT DOCUMENTS

CN 85202420 12/1986
CN 1524995 9/2004

(Continued)

OTHER PUBLICATIONS

"Office Action of Taiwan Counterpart Application" , issued on Jun. 29, 2015, p. 1-p. 5, in which the listed references were cited.

(Continued)

*Primary Examiner* — Joseph L Perrin
(74) *Attorney, Agent, or Firm* — Jianq Chyun IP Office

(57) ABSTRACT

A cleaning apparatus adapted to clean at least one object is provided. The cleaning apparatus includes a chamber, a fixed assembly, a movable assembly and a driving unit. The chamber is adapted to receive a cleaning liquid. The fixed assembly is disposed within the chamber. The movable assembly is movably disposed on the fixed assembly. The object is adapted to be hanged on the fixed assembly or the movable assembly. The driving unit is connected to the movable assembly and adapted to drive the movable assembly to perform a reciprocating motion along a first direction, so that the object is clapped by the fixed assembly and the movable assembly.

20 Claims, 4 Drawing Sheets

(56) References Cited

U.S. PATENT DOCUMENTS

| | | | | | |
|---|---|---|---|---|---|
| 2,023,013 | A | * | 12/1935 | Faber | D06F 15/00 427/242 |
| 2,282,332 | A | * | 5/1942 | Kuhn | D06F 13/04 68/122 |
| 2,303,921 | A | * | 12/1942 | Dyer | D06F 13/04 68/23.6 |
| 2,480,150 | A | * | 8/1949 | Rudolf | A47L 15/0068 134/76 |
| 3,091,955 | A | * | 6/1963 | Taylor | D06F 13/04 34/164 |
| 3,513,497 | A | * | 5/1970 | Vallverdu | A47L 15/37 144/135.3 |

FOREIGN PATENT DOCUMENTS

| | | |
|---|---|---|
| CN | 1732299 | 2/2006 |
| CN | 101328660 | 12/2008 |
| CN | 201261839 | 6/2009 |
| CN | 102720036 | 10/2012 |
| CN | 202576926 | 12/2012 |
| CN | 103266447 | 8/2013 |
| CN | 103911793 | 7/2014 |
| JP | 2006122687 | 5/2006 |
| TW | 200609045 | 3/2006 |

OTHER PUBLICATIONS

"Office Action of China Counterpart Application", issued on Aug. 1, 2016, p. 1-p. 6, in which the listed references were cited.

* cited by examiner

CLEANING APPARATUS

CROSS-REFERENCE TO RELATED APPLICATION

This application claims the priority benefit of Taiwan application serial no. 103113039, filed on Apr. 9, 2014. The entirety of the above-mentioned patent application is hereby incorporated by reference herein and made a part of this specification.

BACKGROUND OF THE INVENTION

1. Field of the Invention

The invention generally relates to a cleaning apparatus, and more particularly, the invention relates to a water cleaning type cleaning apparatus.

2. Description of Related Art

Traditional water cleaning washing machines are divided into forms of vertical axis, horizontal axis, inclined drum and so forth, whereby laundry within a laundering chamber is cleaned by using a motor to rotate the laundering chamber or stirring leaves. In detail, the traditional water cleaning washing machines use water and water-soluble detergent to do the laundry, and the laundry is stirred, collided, rubbed, tumbled or squeezed following the rotation of the laundering chamber or the stirring leaves, such that the detergent infiltrates clothing fibers along with the water and combines with dirt stain to form sludge, and the sludge dissolves and flows away with water stream. Next, the laundering chamber is rotated to dewater the laundry, so as to collect sewage in an outer chamber of the washing machine and thereby discharge the sewage through a pipe. Finally, clean water is filled into the laundering chamber to rinse the laundry. The above procedure is repeatedly performed until the laundry is done. However, the cleaning method of the traditional water cleaning washing machines has the following drawbacks.

It requires a large amount of power for the motor to rotate the laundering chamber, and resistances generated as many pieces of clothing are rubbing against each other when moving in water are large, and thus it also takes a great amount of power for the motor to rotate the stirring leaves. Furthermore, many traditional water cleaning washing machines repeatedly drives the laundering chamber or the stirring leaves to perform forward or reverse rotations, and the washing machines have to be stopped and restarted when switching between the forward and reverse rotations, whereby restarting the washing machines requires a large amount of electric current, and thus it is relatively power consuming. Besides, the scrubbing of the stirring leaves to the clothes and the rubbing between the clothes would all cause the clothes to be worn out.

Clothes are easily tangled as being washed by means of rotating the laundering chamber or the stirring leaves. Contact surfaces between the clothes tangled at an inner layer and the water stream are reduced, and thereby lowers the chances for the detergent to contact the dirt stains, and the clothes tangled at an outer layer block the sludge from dissolving and flowing into the water stream, and thus the clothes tangled at the inner layer are less likely to be washed clean, and the clothes tangled at the outer layer are more likely to be washed clean. That is, the cleanness of the laundry varies in degrees, and excessive cleaning of the laundry is wasteful, such that it requires to repeat the cleaning process for several times in order to actually clean the entire load of laundry, thereby consuming longer cleaning time and much more water and energy.

The traditional water cleaning washing machine, as described in the above, includes the laundering chamber and the outer chamber. This type of double chamber structure enables the washing machine to have larger volume and weight, and thus making it not conducive for packing and handling, and may increase the production cost and the difficulty in assembling.

When the laundering chamber is being rotated to dewater the clothes, uneven weight distribution in the clothes within the laundering chamber is apt to cause the laundering chamber and the apparatus body to be imbalanced, thereby causing damages to the structure of the washing machine, and thus the washing machine has insufficient reliability. In addition, dewatering the clothes by means of rotation, the clothes may squeeze each other due to a powerful centrifugal force, thereby resulting in buckling and deformation, and if the clothes are then tumble dried, wrinkles on the clothes would become even more apparent. Moreover, after the clothes are cleaned and dewatered in the washing machine, the clothes have to be spread out one by one and hanged on a clothes drying rack in order to be line dried; and in this process, because the clothes still contain water, it requires more labor and time to spread out and hang the clothes.

SUMMARY OF THE INVENTION

The invention is directed to a cleaning apparatus having favorable cleaning ability and is capable of saving electricity and water consumptions, shortening cleaning time, increasing reliability, reducing volume and weight, and lowering the production cost.

The cleaning apparatus of the invention is adapted to clean at least one object. The cleaning apparatus includes a chamber, a fixed assembly, a movable assembly and a driving unit. The chamber is adapted to receive a cleaning liquid. The fixed assembly is disposed within the chamber. The movable assembly is movably disposed on the fixed assembly. The object is adapted to be hanged on the fixed assembly or the movable assembly. The driving unit is connected to the movable assembly and adapted to drive the movable assembly to perform a reciprocating motion along a first direction, so that the object is clapped by the fixed assembly and the movable assembly.

In an embodiment of the invention, the cleaning apparatus is a water cleaning washing machine, wherein the object is a load of laundry (i.e., a piece of clothing or a plurality of clothes), and the cleaning liquid includes water and detergent.

In an embodiment of the invention, the fixed assembly includes a first rack and at least one first frame, the movable assembly includes a second rack and at least one second frame, the first rack is fixed within the chamber, the second rack is slidably disposed within the first rack along the first direction and connected to the driving unit, the first frame and the second frame are respectively fixed at the first rack and the second rack and are arranged with interval along the first direction, and the object is adapted to be hanged on the first frame or the second frame and at least partially located between the first frame and the second frame.

In an embodiment of the invention, amounts of the at least one object, the at least one first frame and the at least one second frame are all being a plurality, the first frames and the second frames are staggeredly arranged with intervals along the first direction, and the objects are adapted to be respectively hanged on the first frames or respectively hanged on the second frames.

In an embodiment of the invention, the top of the first rack has at least one first hook slot, the top of the first frame has at least one first hook, and the first frame is adapted to be hanged on the first hook slot via the first hook.

In an embodiment of the invention, the top of the second rack has at least one second hook slot, the top of the second frame has at least one second hook, and the second frame is adapted to be hanged on the second hook slot via the second hook.

In an embodiment of the invention, the bottom of the first rack has at least one first positioning hole, the bottom of the first frame has at least one first positioning protruding portion, and the first frame is adapted to be positioned at the first positioning hole via the first positioning protruding portion.

In an embodiment of the invention, the bottom of the second rack has at least one second positioning hole, the bottom of the second frame has at least one second positioning protruding portion, and the second frame is adapted to be positioned at the second positioning hole via the second positioning protruding portion.

In an embodiment of the invention, the bottom of the first rack has at least one rail, the bottom of the second rack has at least one roller, the rail extends along the first direction, and the roller is leaned on the rail.

In an embodiment of the invention, the cleaning apparatus further includes a scrub member, wherein the scrub member is disposed at the top of the first rack and adjacent to the top of the first frame and the top of the second frame.

In an embodiment of the invention, the first frame has a first reticular structure, and the cleaning liquid is adapted to pass through the first reticular structure to contact the object.

In an embodiment of the invention, the second frame has a second reticular structure, and the cleaning liquid is adapted to pass through the second reticular structure to contact the object.

In an embodiment of the invention, the first rack has at least one third reticular structure, and the cleaning liquid is adapted to pass through the third reticular structure to contact the object.

In an embodiment of the invention, the second rack has at least one fourth reticular structure, and the cleaning liquid is adapted to pass through the fourth reticular structure to contact the object.

In an embodiment of the invention, the driving unit includes a driving source and a driving arm, wherein the driving source is connected to the driving arm and adapted to drive the driving arm to perform the reciprocating motion along the first direction, the driving arm has a connecting pin, the bottom of the second rack has a connection hole, and the connection hole is inserted with the connecting pin along a second direction perpendicular to the first direction.

In an embodiment of the invention, the chamber has an opening, the driving source is disposed outside of the chamber, the driving arm extends into the chamber through the opening, the driving unit further comprises an elastic membrane, and the elastic membrane is connected to the driving arm and the chamber and covers the opening.

In an embodiment of the invention, the cleaning apparatus includes a control unit, wherein the control unit is coupled to the driving unit, when the cleaning liquid is accommodated within the chamber, the control unit controls the driving unit to drive the movable assembly to perform the reciprocating motion with a first frequency and a first vibration amplitude, so that the object is clapped by the fixed assembly and the movable assembly.

In an embodiment of the invention, after the cleaning liquid is discharged from the chamber, the control unit controls the driving unit to drive the movable assembly to perform the reciprocating motion with a second frequency and a second vibration amplitude, so as to shake off the cleaning liquid remaining on the object.

In an embodiment of the invention, the cleaning apparatus further includes a hot air system, wherein the hot air system is adapted to provide hot air into the chamber.

In an embodiment of the invention, the movable assembly is adapted to separate the fixed assembly.

In an embodiment of the invention, the cleaning apparatus further includes a circulation pump, wherein the circulation pump is connected to the chamber, and the cleaning liquid discharged from the chamber is circulated into the chamber through the circulation pump.

In view of above, the cleaning apparatus of the invention drives the movable assembly to perform the reciprocating motion in relative to the fixed assembly, so that the object (i.e., a load of laundry) hanged on the fixed assembly or the movable assembly is clapped by the fixed assembly and the movable assembly along with the reciprocating motion of the movable assembly, and the cleaning liquid is maintained to be flowing on the object (i.e., a load of laundry) by using the circulation pump and the sprinkler, so that the clothes are cleaned by the water stream and the detergent along with clapping. Since the aforesaid clapping clean process only requires to drive the movable assembly into performing the reciprocating motion and maintain the circulation of the cleaning liquid, instead of driving the laundering chamber or the stirring leaves into rotation similar to the traditional washing machine, power may be saved and the clothes may be avoided from wearing out due to scrubbing of the stirring leaves to the clothes and the rubbing between the clothes. In addition, by using the aforesaid clapping method to clean the clothes, the clothes are less likely to be tangled, and thus it may be ensured that the clothes have sufficient contact surfaces with the water stream and are apt to be washed clean, thereby saving the cleaning time and the water consumption.

Upon completion of cleaning the clothes, water remained on the clothes may be shaken off via the reciprocating motion of the movable assembly, without requiring to dewater the clothes by rotating the chamber similar to the traditional washing machine, and thus imbalance in the apparatus body due to uneven weight distribution in the clothes may be avoided, thereby reducing the chances of damaging the cleaning apparatus and enhancing a reliability thereof. Besides, by using the reciprocating motion to shake off the water remained on the clothes rather than by rotating the chamber to dewater the clothes, the clothes may be prevented from squeezing each other, thereby resulting in buckling and deformation, due to centrifugal force. Moreover, since the clothes are already hanged on the fixed assembly or the movable assembly before the cleaning process, the clothes may be line dried directly on the fixed assembly or the movable assembly after the wash is completed, such that the clothes are no longer required to be line dried by being spread out one by one and hanged on a clothes drying rack, and thereby saves the user time.

Furthermore, the cleaning apparatus of the invention is configured with only a single chamber rather than including a laundering chamber and an outer chamber (i.e., being a double chamber structure) similar to the traditional washing machine, and thus may effectively reduce the volume and the weight of the apparatus, make it easy for packing and handling, and may lower the production cost and the difficulty in assembling.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
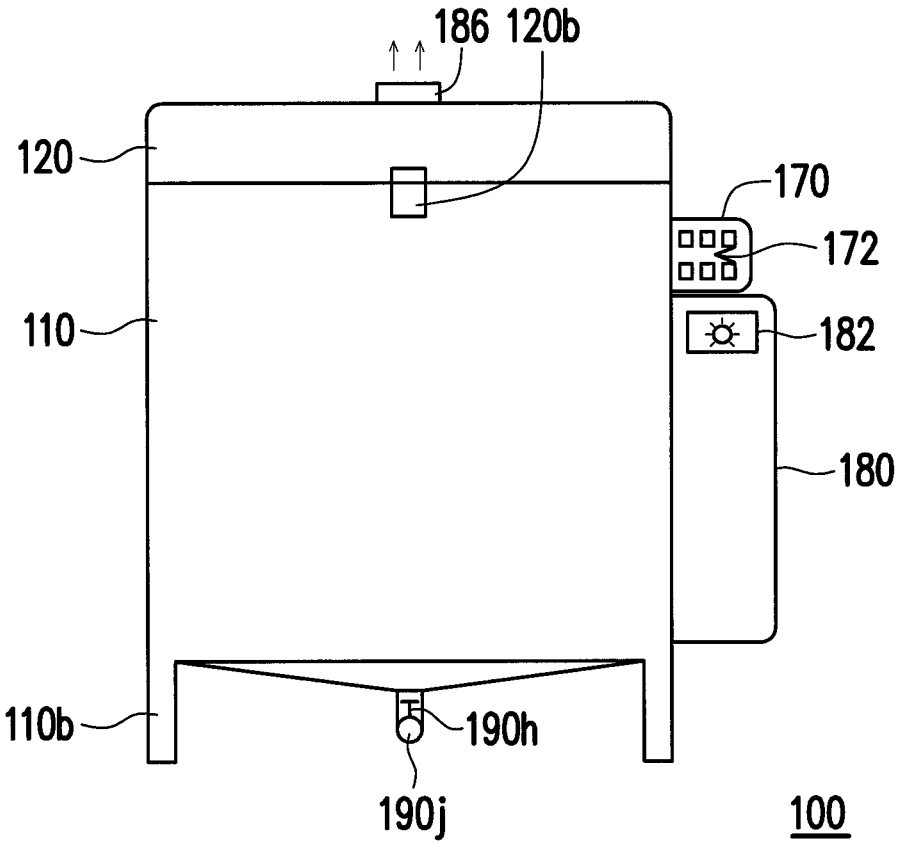
FIG. 1 is a front view of a cleaning apparatus according to an embodiment of the invention.
Figure 2:
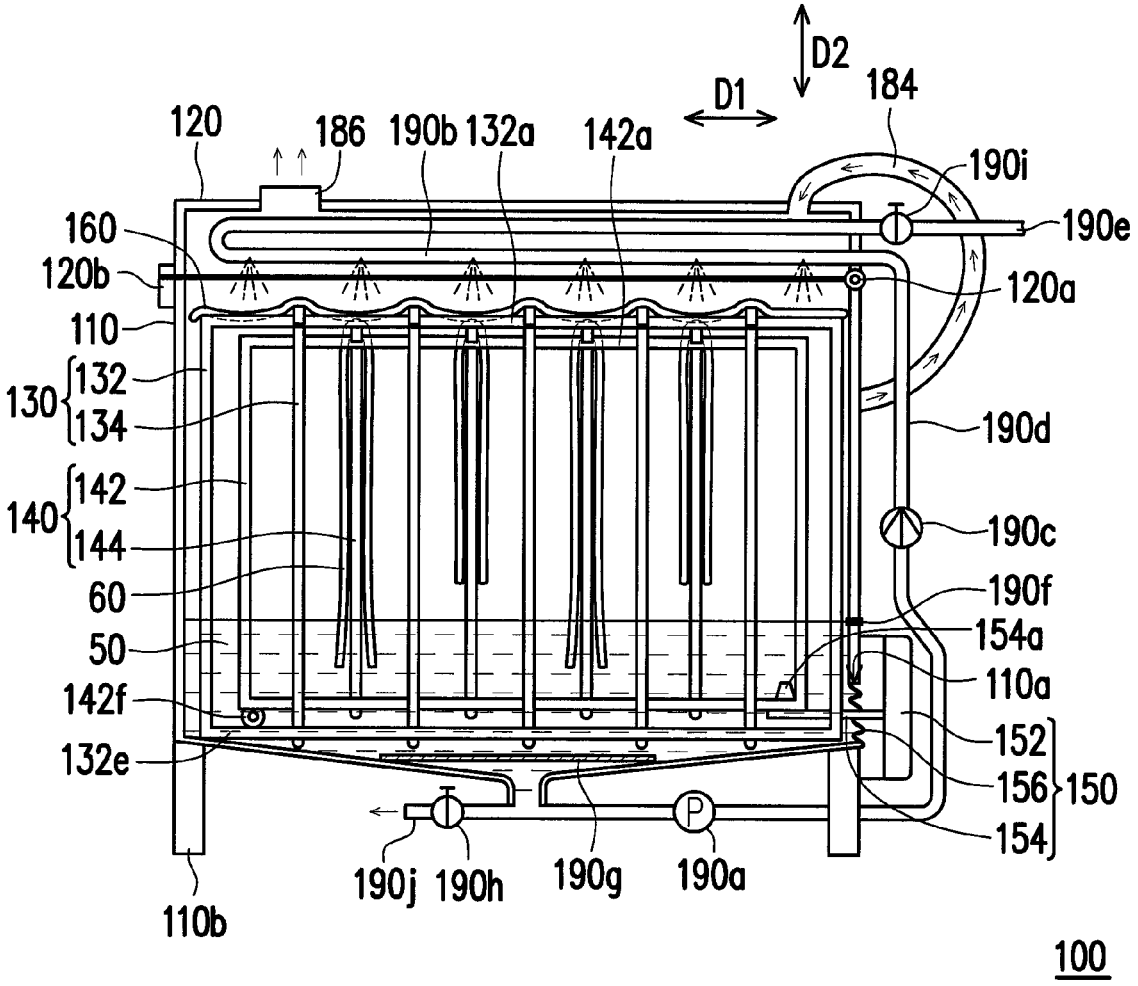
FIG. 2 is a schematic longitudinal cross-sectional view illustrating the cleaning apparatus of FIG. 1.

FIG. 1 is a front view of a cleaning apparatus according to an embodiment of the invention. FIG. 2 is a schematic longitudinal cross-sectional view illustrating the cleaning apparatus of FIG. 1. Referring to FIG. 1 and FIG. 2, a cleaning apparatus 100 of the present embodiment, for example, is a water cleaning washing machine and includes a chamber 110, a cover 120, a fixed assembly 130, a movable assembly 140 and a driving unit 150. The chamber 110 is supported by foot stands 110*b* thereof and adapted to receive a cleaning liquid 50, and the cleaning liquid 50, for example, is water and water-soluble detergent. The cover 120 is coupled to the chamber 110 through a hinge 120*a* and is configured to cover the chamber 110. The fixed assembly 130 is disposed within the chamber 110, and the movable assembly 140 is movably disposed on the fixed assembly 130. An object to be washed, for example, is a load of laundry (viz., a plurality of clothes) 60 and is adapted to be spread flat and hanged on the fixed assembly 130 or the movable assembly 140 (FIG. 2 illustrates a load of laundry 60 hanging on the movable assembly 140).

The driving unit 150 is connected to the movable assembly 140 and adapted to drive the movable assembly 140 to perform a reciprocating motion along a first direction D1, so that each piece of laundry 60 is clapped by the fixed assembly 130 and the movable assembly 140 along with the reciprocating motion of the movable assembly 140. The cleaning apparatus 100 further includes a circulation pump 190*a* and a sprinkler 190*b*, the circulation pump 190*a* is connected to the chamber 110, and the sprinkler 190*b* is located above the chamber 110. The cleaning liquid 50 discharged from the chamber 110 is pumped by the circulation pump 190*a* to the sprinkler 190*b* to be sprayed, so as to enable the cleaning liquid 50 to circulate into the chamber 110, such that the cleaning liquid 50 continues to flow and cleans each piece of laundry 60 along with the clapping. Since the aforesaid clapping clean process only requires to drive the movable assembly 140 into performing the reciprocating motion and circulate the cleaning liquid 50, rather than driving a laundering chamber or stirring leaves into rotation similar to a traditional washing machine, power may be saved and the clothes may be avoided from wearing out due to scrubbing of the stirring leaves to the clothes and the rubbing between the clothes. In addition, by using the aforesaid clapping method to clean the laundry 60, the laundry 60 are less likely to be tangled, and thus it may be ensured that the laundry 60 have sufficient contact surfaces with the cleaning liquid 50 and are apt to be washed clean, thereby saving the cleaning time and the water consumption.

Upon completion of cleaning the laundry 60, water remained on each piece of laundry 60 may be shaken off via the reciprocating motion of the movable assembly 140 along a first direction D1, without requiring to dewater the laundry by rotating the chamber similar to the traditional washing machine, and thus imbalance in the apparatus body due to uneven weight distribution in the laundry may be avoid, thereby reducing the chances of damaging the cleaning apparatus 100 and enhancing a reliability thereof. Besides, by using the reciprocating motion to shake off the water remained on each piece of laundry 60 rather than by rotating the chamber to dewater the laundry 60, the pieces of laundry 60 may be prevented from squeezing each other, thereby resulting in buckling and deformation, due to centrifugal force. Moreover, since each piece of laundry 60 is already hanged on the movable assembly 140 before the cleaning process, each piece of laundry 60 may be line dried or tumble dried directly on the movable assembly 140 after the cleaning is completed, such that all the pieces of the laundry 60 are no longer required to be line dried by being spread out one by one and hanged on a clothes drying rack, and thereby saves the user time.

Furthermore, the cleaning apparatus 100 of the present embodiment is configured with only a single chamber 110 rather than including a laundering chamber and an outer chamber (i.e., being a double chamber structure) similar to the traditional washing machine, and thus may effectively reduce the volume and the weight of the apparatus, may make it easy for packing and handling, and may lower the production cost and the difficulty in assembling.

Figure 3:
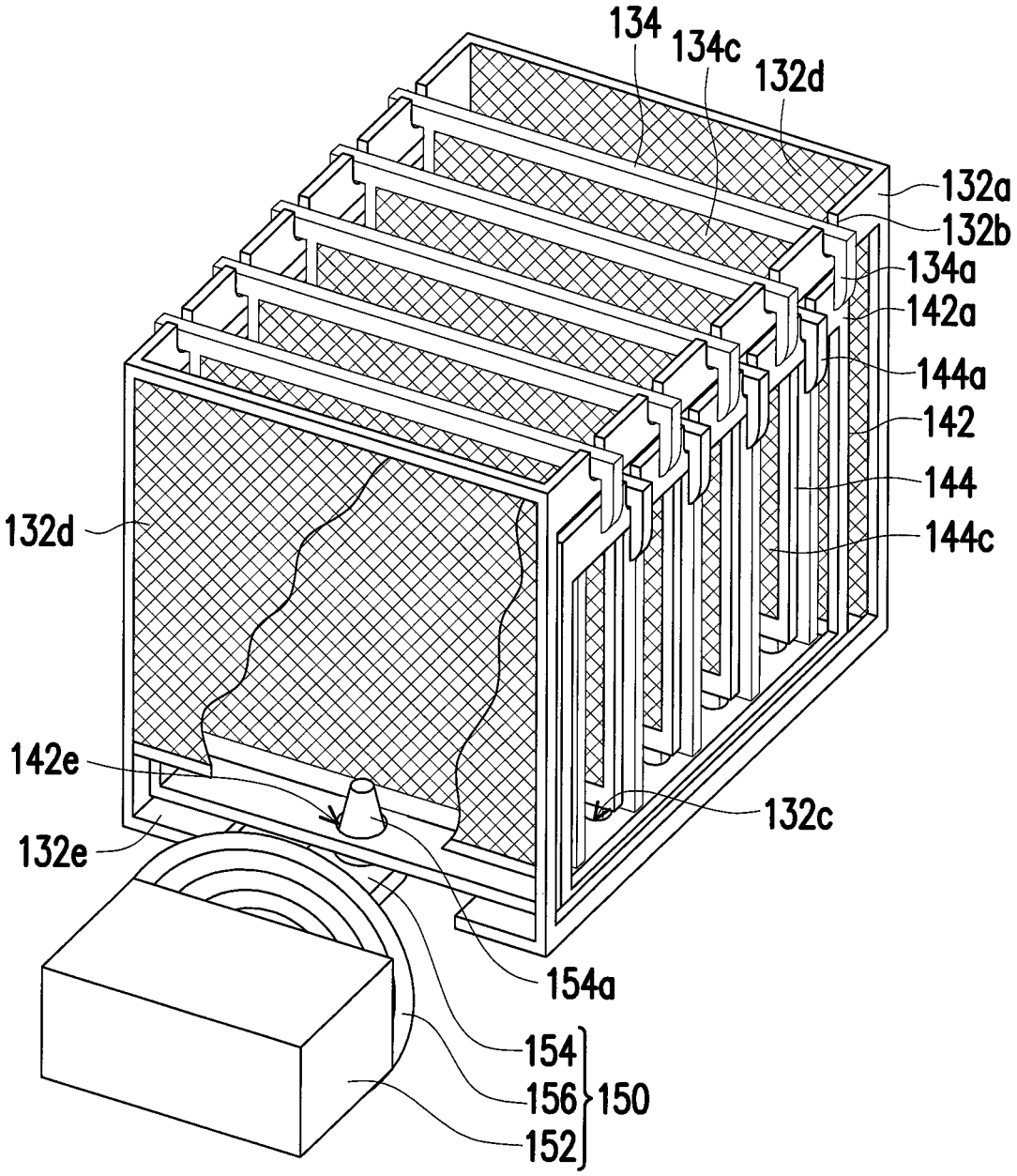
FIG. 3 is a perspective view illustrating partial components of the cleaning apparatus of FIG. 2.
Figure 4:
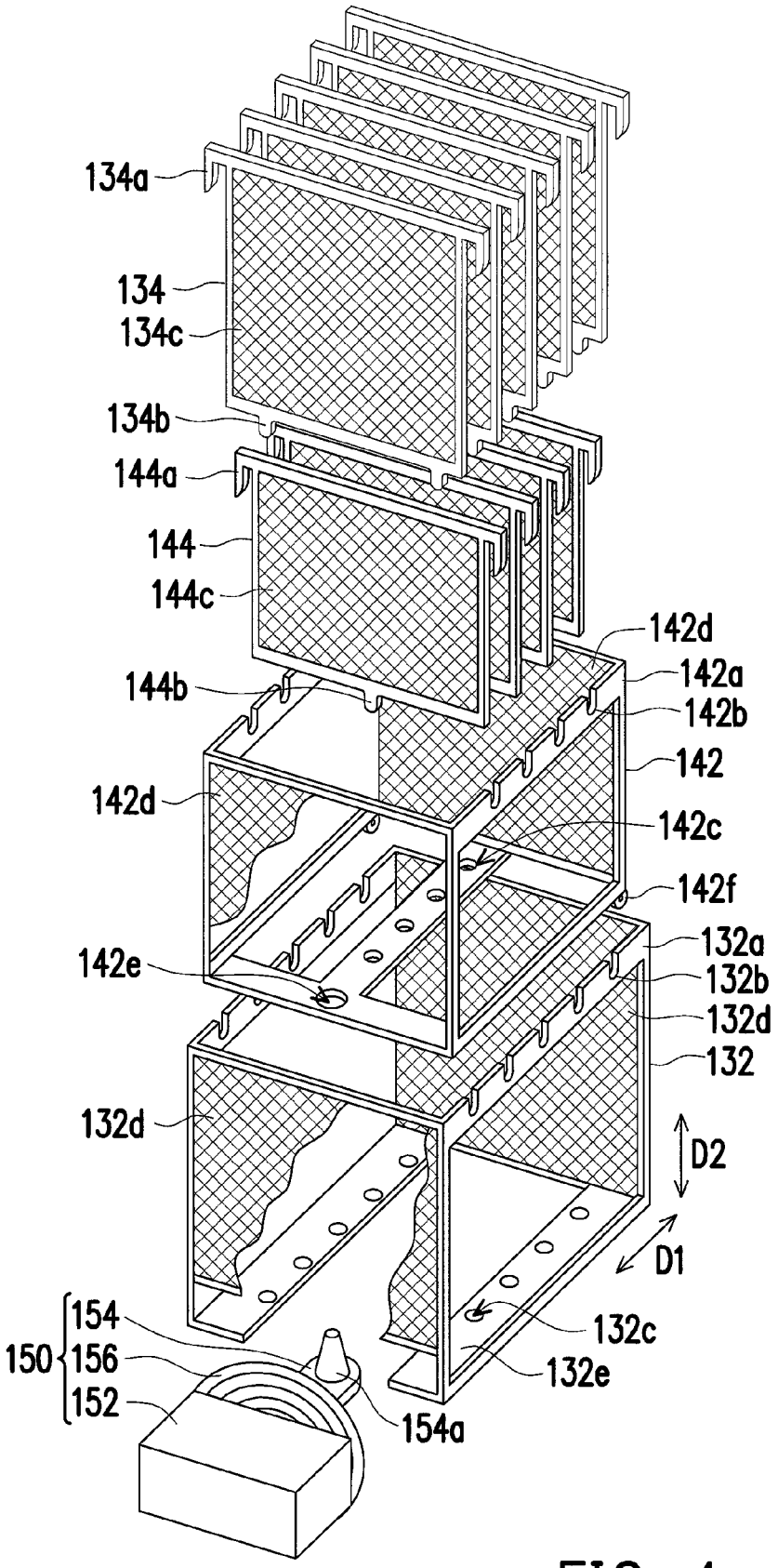
FIG. 4 is an exploded view illustrating partial components of the cleaning apparatus of FIG. 2.

FIG. 3 is a perspective view illustrating partial components of the cleaning apparatus of FIG. 2. FIG. 4 is an exploded view illustrating partial components of the cleaning apparatus of FIG. 2. Referring to FIG. 2 through FIG. 4, specifically, the fixed assembly 130 of the present embodiment includes a first rack 132 and at least one first frame 134 (illustrated as a plurality), and the movable assembly 140 includes a second rack 142 and at least one second frame 144 (illustrated as a plurality). The first rack 132, for example, is a cube-shaped rack and is fixed within the chamber 110, and the second rack 142, for example, is a cube-shaped rack and is slidably disposed within the first rack 132 along the first direction D1 and connected to the driving unit 150. The first frames 134 and the second frames 144 are respectively fixed at the first rack 132 and the second rack 134 and are staggeredly arranged with intervals along the first direction D1, and the pieces of laundry 60 are adapted to be respectively hanged on the first frames 134 or respectively hanged on the second frames 144 (FIG. 2 illustrates the pieces of laundry 60 respectively hanged on the second frames 144). Each piece of laundry 60 is at least partially located between the adjacent first frame 134 and second frame 144.

Referring to FIG. 3 and FIG. 4, more specifically, a cantilever 132*a* at the top of the first rack 132 has at least one first hook slot 132*b* (illustrated as a plurality), the top of each of the first frames 134 has at least one first hook 134*a* (illustrated as two), and each of the first frames 134 is adapted to be hanged on two corresponding first hook slots

132*b* through using the two first hooks 134*a*. In addition, the bottom of the first rack 132 has at least one first positioning hole 132*c* (illustrated as a plurality), the bottom of each of the first frames 134 has at least one first positioning protruding portion 134*b* (illustrated as two), and each of the first frames 134 is adapted to be positioned at two corresponding first positioning holes 132*c* through using the two first positioning protruding portions 134*b*.

Similarly, a cantilever 142*a* at the top of the second rack 142 has at least one second hook slot 142*b* (illustrated as a plurality), the top of each of the second frames 144 has at least one second hook 144*a* (illustrated as two), and each of the second frames 144 is adapted to be hanged on two corresponding second hook slots 142*b* through using the two second hooks 144*a*. In addition, the bottom of the second rack 142 has at least one second positioning hole 142*c* (illustrated as a plurality), the bottom of each of the second frames 144 has at least one second positioning protruding portion 144*b* (illustrated as one), and each of the second frames 144 is adapted to positioned at the corresponding second positioning hole 132*c* through using the second positioning protruding portion 144*b*.

In the present embodiment, each of the first frames 134 has a first reticular structure 134*c* being a net with frame, and each of the second frames 144 has a second reticular structure 144*c* being a net with frame. The first rack 132 has at least one third reticular structure 132*d* (illustrated as two), and the second rack 142 has at least one fourth reticular structure 142*d* (illustrated as two). The cleaning liquid 50 (shown in FIG. 2) is adapted to pass through each of the first reticular structures 134*c*, each of the second reticular structures 144*c*, each of the third reticular structures 132*d* and each of the fourth reticular structures 142*d* to contact the pieces of laundry 60.

Referring to FIG. 2 through FIG. 4, the driving unit 150 of the present embodiment includes a driving source 152 and a driving arm 154. The driving arm 154 has a connecting pin 154*a*, the bottom of the second rack 142 has a connection hole 142*e* capable of being inserted with the connecting pin 154*a* along a second direction D2 perpendicular to the first direction D1, and the driving source 152 is connected to the driving arm 154 and adapted to drive the driving arm 154 to perform the reciprocating motion along the first direction D1, so as to drive the second rack 142 to perform the reciprocating motion along the first direction D1.

Furthermore, the chamber 110 of the present embodiment has an opening 110*a* (shown in FIG. 2), and the driving unit 150 further includes an elastic membrane 156. The driving source 152 is disposed outside of the chamber 110, the driving arm 154 extends into the chamber 110 through the opening 110*a* of the chamber 110, and the elastic membrane 156 is connected to the driving arm 154 and the chamber 110 and covers the opening 110*a*. When the driving arm 154 performs reciprocating motion along the first direction D1, the elastic membrane 156 produces an elastic deformation along with the movement of the driving arm 154 and thereby maintaining a state of covering the opening 110*a*, so as to prevent the cleaning liquid 50 within the chamber 110 from flowing to the outside of the chamber 110 through the opening 110*a*.

In the present embodiment, the bottom of the first rack 132 has at least one rail 132*e* (illustrated as two) extending along the first direction D1, and the bottom of the second rack 142 has at least one roller 142*f* (illustrated as two). The two rollers 142*f* are respectively leaned on the two rails 132*e*, so that the second rack 142 is stably slidably disposed in the first rack 132 with the support of the connecting pin 154*a* and the two rollers 142*f* (viz., three-point support), and the second rack 142 can smoothly perform the reciprocating motion on the first rack 132 by rolling the two rollers 142*f*.

Referring to FIG. 2, the cleaning apparatus 100 of the present embodiment further includes a scrub member 160. The scrub member 160, for example, is a mesh fabric or other types of scrub member, which has favorable water permeability and air permeability, and is disposed at the top of the first rack 132 and adjacent to the tops of the first frames 134 and the tops of second frames 144. During the process whereby the movable assembly 140 performs the reciprocating motion along the first direction D1, a portion of each piece of laundry 60 located on the top of the second frame 144 may be difficult to be clapped by the first frame 134 and the second frame 144, and thus the said portion of each piece of laundry 60 may be washed by the scrub member 160 so that each piece of laundry 60 can be completely cleaned.

Details regarding a specific method for operating the cleaning apparatus 100 of the present embodiment are provided in below. When a user desires to use the cleaning apparatus 100, the user may firstly take out the fixed assembly 130 and the movable assembly 140 from the chamber 110, then a proper amount of water (such as being ⅕ volume of the chamber 110) is filled into the chamber 110 through a clean water filling pipe 190*e* and a clean water injection valve 190*i*, and a proper amount of detergent is also added into the water, wherein a water level controller 190*f* as shown in FIG. 2 may, for example, be used to control the water level within the chamber 110. The pieces of laundry 60 which are to be washed are respectively hanged on the second frames 144 of the movable assembly 140, and the second frames 144 are then installed onto the second rack 142. Next, the second rack 142 and the second frames 144 thereon are placed into the first rack 132 of the fixed assembly 130, and the first frames 134 are then installed onto the first rack 132 so that the first frames 134 and the second frames 144 are staggeredly arranged with intervals. After the detergent is sufficiently dissolved in the water, the fixed assembly 130 and the movable assembly 140 therein are placed into the chamber 110 together with the laundry 60, so that the movable assembly 140 is connected to the driving unit 150, and the scrub member 160 is placed on the top of the first rack 132.

Next, the cover 120 is closed onto the chamber 110, so as to shut the cover and turn on a power switch 120*b*. Then, the circulation pump 190*a* as shown in FIG. 2 is used to pump the water to the sprinkler 190*b*, wherein a check valve 190*c* is, for example, being used to stop the water from backflowing to the circulation pump 190*a*. When the driving unit 150 drives the movable assembly 140 to perform the reciprocating motion, water sprayed downward by the sprinkler 190*b* passes through the scrub member 160 and flows down along the pieces of laundry 60 and then washes the pieces of laundry 60 along with the reciprocating motion of the movable assembly 140. In this cleaning process, the water within the chamber 110 is, for example, constantly recycled by a recycling pipe 190*d*, and a bottom filter 190*g* is used to prevent objects (i.e., cottons or buttons which fall off from the laundry 60) within the chamber 110 from entering the circulation pump 190*a* along the water stream. After completing the cleaning of the laundry 60, the water sprayed down from the sprinkler 190*b* is used to rinse the laundry 60 clean, and since the pieces of laundry 60 are arranged with intervals and may unevenly contact the water stream, they may easily be rinsed clean.

Referring to FIG. 1, in the present embodiment, the cleaning apparatus 100 includes a control unit 170, and the control unit 170 is coupled to the driving unit 150 as shown in FIG. 2 through FIG. 4 and has an operation interface 172 for the user to operate. When the cleaning liquid 50 is accommodated within the chamber 110 and adapted to wash the laundry 60, the user may activate the circulation pump 190*a* and control the driving unit 150 to drive the movable assembly 140 to perform the reciprocating motion with a first frequency and a first vibration amplitude by using the control unit 170, so that the pieces of laundry 60 are clapped by the first frames 134 of the fixed assembly 130 and the second frames 144 of the movable assembly 140. The first frequency, for example, is a resonant frequency under a condition that the cleaning liquid 50 is presented along with the laundry 60 in the chamber 110, and the first vibration amplitude, for example, is a proper value set according to a distance between each of the first frames 134 and the adjacent second frame 144 thereof, so that the pieces of laundry 60 can be sufficiently clapped by the first frames 134 and the second frames 144 driven by the driving unit 150.

After the pieces of laundry 60 are washed and the majority of cleaning liquid 50 is discharged from chamber 110 through a drain valve 190*h* and a drainpipe 190*j*, the user may control the driving unit 150 to control and drive the movable assembly 140 to perform the reciprocating motion with a second frequency and a second vibration amplitude by using the control unit 170, thereby shaking off the cleaning liquid 50 remained on each piece of laundry 60. The second frequency, for example, is an another resonant frequency under a condition that the laundry 60 is remained within the chamber 110 while the majority of the cleaning liquid 50 is discharged. The second vibration amplitude, for example, is a proper value set according to a distance between each of the first frames 134 and the adjacent second frame 144 thereof, so that the cleaning liquid 50 remained on the pieces of laundry 60 can quickly be shaken off as driven by the driving unit 150.

In the present embodiment, the control unit 170, in addition to being configured to control the driving unit 150, is further configured to control the clean water injection valve 190*i*, the circulation pump 190*a* and the drain valve 190*h*, so the water stream can smoothly be filled into and discharged from the cleaning apparatus 100.

Referring to FIG. 1, in the present embodiment, the cleaning apparatus 100 includes a hot air system 180 having a temperature regulator 182 for the user to operate. The hot air system 180 is adapted to provide hot air into the chamber 110 through a hot air injection pipe 184 as shown in FIG. 2, so as to dry the laundry 60, and the hot air is discharged to the outside through an outlet 186. In addition, the movable assembly 140 of the present embodiment is adapted to be separated from the fixed assembly 130, and the laundry 60 may also not be tumble dried by the hot air system 180, such that the user may take the movable assembly 140 out from the chamber 110 and let the laundry 60 hanged on the movable assembly 140 to be dried naturally.

In summary, the cleaning apparatus of the invention drives the movable assembly to perform the reciprocating motion in relative to the fixed assembly and maintains the circulation of water stream, so that the object (i.e., a load of laundry) hanged on the fixed assembly or the movable assembly is clapped by the fixed assembly and the movable assembly along with the reciprocating motion of the movable assembly, and the cleaning liquid is maintained to be flowing on the object (i.e., a load of laundry) by using the circulation pump and the sprinkler, so that the clothes are cleaned by the water stream and the detergent along with clapping. Since the aforesaid clapping clean process only requires to drive the movable assembly into performing the reciprocating motion and maintain the circulation of the cleaning liquid, instead of driving the laundering chamber or the stirring leaves into rotation similar to the traditional washing machine, power may be saved and the clothes may be avoided from wearing out due to scrubbing of the stirring leaves to the clothes and the rubbing between the clothes. In addition, by using the aforesaid clapping method to clean the clothes, the clothes are less likely to be tangled, and thus it may be ensured that the clothes have sufficient contact surfaces with the water stream and are apt to be washed clean, thereby saving the cleaning time and the water consumption.

Upon completion of cleaning the clothes, water remained on the clothes may be shook off via the reciprocating motion of the movable assembly, without requiring to dewater the clothes by rotating the chamber similar to the traditional washing machine, and thus imbalance in the apparatus body due to uneven weight distribution in the clothes may be avoided, thereby reducing the chances of damaging the cleaning apparatus and enhancing a reliability thereof. Besides, by using the reciprocating motion to shake off the water remained on the clothes rather than by rotating the chamber to dewater the clothes, the clothes may be prevented from squeezing each other, thereby resulting in buckling and deformation, due to centrifugal force. Moreover, since the clothes are already hanged on the fixed assembly or the movable assembly before the cleaning process, the clothes may be line dried or tumble dried directly on the fixed assembly or the movable assembly after the cleaning is completed, such that the clothes are no longer required to be line dried by being spread out one by one and hanged on a clothes drying rack, and thereby saves the user time.

Furthermore, the cleaning apparatus of the invention is configured with only a single chamber rather than including a laundering chamber and an outer chamber (i.e., being a double chamber structure) similar to the traditional washing machine, and thus may effectively reduce the volume and the weight of the apparatus, make it easy for packing and handling, and may lower the production cost and the difficulty in assembling.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A cleaning apparatus adapted to clean at least one object, the cleaning apparatus comprising:

a chamber adapted to receive a cleaning liquid;

a fixed assembly fixed within the chamber;

a movable assembly movably disposed on the fixed assembly, wherein the object is adapted to be hanged on the fixed assembly or the movable assembly; and a driving unit connected to the movable assembly and adapted to drive the movable assembly to perform a reciprocating motion along a first direction, so that the object is clapped by the fixed assembly and the movable assembly, wherein the fixed assembly comprises a first rack and at least one first frame, the movable assembly comprises a second rack and at least one second frame, the first rack is fixed within the chamber, the second rack is slidably disposed within the first rack along the first direction and connected to the driving unit, the first frame and the second frame are respectively fixed at the first rack and the second rack and are arranged with interval along the first direction, and the object is adapted to be hanged on the first frame or the second frame and at least partially located between the first frame and the second frame.

2. The cleaning apparatus as recited in claim 1, wherein the cleaning apparatus is a water cleaning washing machine, wherein the object is a load of laundry, and the cleaning liquid comprises water and detergent.

3. The cleaning apparatus as recited in claim 1, wherein amounts of the at least one object, the at least one first frame and the at least one second frame are all being a plurality, the first frames and the second frames are staggeredly arranged with intervals along the first direction, and the objects are adapted to be respectively hanged on the first frames or respectively hanged on the second frames.

4. The cleaning apparatus as recited in claim 1, wherein the top of the first rack has at least one first hook slot, the top of the first frame has at least one first hook, and the first frame is adapted to be hanged on the first hook slot via the first hook.

5. The cleaning apparatus as recited in claim 1, wherein the top of the second rack has at least one second hook slot, the top of the second frame has at least one second hook, and the second frame is adapted to be hanged on the second hook slot via the second hook.

6. The cleaning apparatus as recited in claim 1, wherein the bottom of the first rack has at least one first positioning hole, the bottom of the first frame has at least one first positioning protruding portion, and the first frame is adapted to be positioned at the first positioning hole via the first positioning protruding portion.

7. The cleaning apparatus as recited in claim 1, wherein the bottom of the second rack has at least one second positioning hole, the bottom of the second frame has at least one second positioning protruding portion, and the second frame is adapted to be positioned at the second positioning hole via the second positioning protruding portion.

8. The cleaning apparatus as recited in claim 1, wherein the bottom of the first rack has at least one rail, the bottom of the second rack has at least one roller, the rail extends along the first direction, and the roller is leaned on the rail.

9. The cleaning apparatus as recited in claim 1, further comprising a scrub member, wherein the scrub member is disposed at the top of the first rack and adjacent to the top of the first frame and the top of the second frame.

10. The cleaning apparatus as recited in claim 1, wherein the first frame has a first reticular structure, and the cleaning liquid is adapted to pass through the first reticular structure to contact the object.

11. The cleaning apparatus as recited in claim 1, wherein the second frame has a second reticular structure, and the cleaning liquid is adapted to pass through the second reticular structure to contact the object.

12. The cleaning apparatus as recited in claim 1, wherein the first rack has at least one third reticular structure, and the cleaning liquid is adapted to pass through the third reticular structure to contact the object.

13. The cleaning apparatus as recited in claim 1, wherein the second rack has at least one fourth reticular structure, and the cleaning liquid is adapted to pass through the fourth reticular structure to contact the object.

14. The cleaning apparatus as recited in claim 1, wherein the driving unit comprises a driving source and a driving arm, wherein the driving source is connected to the driving arm and adapted to drive the driving arm to perform a reciprocating motion along the first direction, the driving arm has a connecting pin, the bottom of the second rack has a connection hole, and the connection hole is inserted with the connecting pin along a second direction perpendicular to the first direction.

15. The cleaning apparatus as recited in claim 14, wherein the chamber has an opening, the driving source is disposed outside of the chamber, the driving arm extends into the chamber through the opening, the driving unit further comprises an elastic membrane, and the elastic membrane is connected to the driving arm and the chamber and covers the opening.

16. The cleaning apparatus as recited in claim 1 further comprising a control unit, wherein the control unit is coupled to the driving unit, when the cleaning liquid is accommodated within the chamber, the control unit controls the driving unit to drive the movable assembly to perform the reciprocating motion with a first frequency and a first vibration amplitude, so that the object is clapped by the fixed assembly and the movable assembly.

17. The cleaning apparatus as recited in claim 16, wherein after the cleaning liquid is discharged from the chamber through a drain valve and a drainpipe, the control unit controls the driving unit to drive the movable assembly to perform the reciprocating motion with a second frequency and a second vibration amplitude, so as to shake off the cleaning liquid remaining on the object.

18. The cleaning apparatus as recited in claim 1, further comprising a hot air system, wherein the hot air system is adapted to provide hot air into the chamber.

19. The cleaning apparatus as recited in claim 1, wherein the movable assembly is adapted to be separated from the fixed assembly.

20. The cleaning apparatus as recited in claim 1, further comprising a circulation pump, wherein the circulation pump is connected to the chamber, and the cleaning liquid discharged from the chamber is circulated into the chamber through the circulation pump.

* * * * *